US005637841A

United States Patent [19]

Dugan et al.

[11] Patent Number: 5,637,841

[45] Date of Patent: Jun. 10, 1997

[54] ELEVATOR SYSTEM

[75] Inventors: W. Michael Dugan, Memphis, Tenn.; E. William Gaudet, Jr., Hernando, Miss.; Herbert M. Ochs, Jr., Memphis, Tenn.

[73] Assignee: Delaware Capital Formation, Inc., Wilmington, Del.

[21] Appl. No.: 323,913

[22] Filed: Oct. 17, 1994

[51] Int. Cl.[6] ..... B66B 1/28

[52] U.S. Cl. ..... 187/294; 187/394; 187/291

[58] Field of Search ..... 187/282, 284, 187/294, 295, 393, 394, 291

[56] References Cited

U.S. PATENT DOCUMENTS 3,779,346 12/1973 Winkler ..... 187/29 R
4,434,874 3/1984 Caputo ..... 187/29 R

FOREIGN PATENT DOCUMENTS 53-140747 12/1978 Japan ..... 187/294
2064819 6/1981 United Kingdom ..... 187/294

*Primary Examiner*—Robert Nappi
*Attorney, Agent, or Firm*—White & Case

[57] ABSTRACT

An elevator system includes a CPU to dictate speed signals during a normal elevator car run, and a normal terminal stopping device (NTSD) to dictate maximum allowable speeds approaching the top and bottom terminal floors. The NTSD system normally operates in monitor mode, where the NTSD profile has the same deceleration rate as the normal speed dictation signals. Should the normal speed dictation signal exceed the NTSD value, the NTSD system switches to a violation mode, having a rate of deceleration greater than the normal deceleration.

A plurality of vanes are located in the hoistway to provide absolute position signals for generating NTSD values. Preferably, when operating in the monitor mode, the NTSD software calculates pseudo checkpoints between the actual vanes, to readjust the NTSD values. Also, preferably the NTSD values during jerk into deceleration are calculated based on the constant deceleration rate during slowdown.

10 Claims, 9 Drawing Sheets

CALCULATE C

INTERPOLATION SUBROUTINE

ELEVATOR SYSTEM

FIELD OF INVENTION

The present invention relates to elevator systems, in particular elevators having a computer-controlled motor drive.

BACKGROUND OF THE INVENTION

Conventional traction elevators include a motor, for moving the car between floors, a solid state elevator drive that dictates the speed and direction of rotation of the motor, and a car logic controller that controls the drive responsive to various elevator operating conditions, such as the activation of car and hall call buttons, the position of the doors, the activation of safeties and, in multiple car elevator banks, commands from the group supervisory control. When responding to a hall or car call, one of the functions of the controller is to generate speed control signals, based on a predetermined acceleration and deceleration speed profile, to move the car quickly and smoothly to the target floor. The speed control signals are fed to the elevator drive which, in turn, produces an appropriate voltage and current output such that the motor rotates at the dictated speed.

During a run between floors, the controller generates the velocity command profile, which may be either time-based or position-based, as a function of instantaneous elevator position and velocity, which are calculated based upon signals from a position encoder mounted on the speed governor. The profile computation takes place in a central processing unit ("CPU"), which sends speed command signals to a speed control computer card containing a digital signal processor ("DSP"). The DSP, in turn, produces speed command signals and sends such signals to the solid state elevator drive, for example an MG, SCR, or variable voltage/variable frequency (VVVF) drive.

Elevators are provided with one or more backup systems to stop the car at the upper and lower ends of the hoistway in the event that the normal speed control signals would fail to do so. One such system is known as the Normal Terminal Stopping Device (NTSD), which is designed to slow down and stop the car at the upper and lower terminal landings when it senses that the normal speed control will overrun the top or bottom floor. For example, if the CPU receives a faulty position encoder signal, the CPU may determine that the car is further away from the terminal than is actually the case, and generate speed signals that, if followed, would carry the car beyond the terminal landing. Should this occur, the NTSD system is designed to override the normal speed signals and bring the car to a stop at the terminal. An NTSD system is required by the ASME ANSI A17.1 Safety Code For Elevators, as well as by various local jurisdictions.

The car is expected to remain in service following an NTSD slowdown and stop, as contrasted with a more drastic emergency stopping device that shuts down a car and keeps it out of service. Thus, the NTSD terminal slowdown pattern must be relatively smooth. Also, it is desirable that the NTSD system should not override the normal control means as long as the CPU-generated speed control signals remain within a certain acceptable range of the correct values. For these reasons, NTSD equipment is designed to provide a backup slowdown pattern similar in profile to the normal slowdown pattern, but that allows some margin of error beyond the normal slowdown pattern generated by the CPU.

In order to be a reliable backup to the normal control system, the NTSD system needs to be independent of the normal control means for stopping the elevator at the terminal. Therefore, while the CPU dictates speed control signals based upon position encoder signals, the NTSD system is based on a table of speed values which are stored separate from the normal speed control signals, and is controlled responsive to vanes which are located in the hoistway, rather than the position encoder, to provide independent verification of actual elevator car position.

In known NTSD systems, a plurality of metal vanes are positioned near the top and bottom of the hoistway, at predetermined distances from the terminal landings, defining a zone within which a terminal slowdown and stop must occur. Each vane is encoded with a series of identifying holes, which are read by an optical sensor on the car. The vanes form a series of fixed checkpoints representing actual elevator position. NTSD speed values are set during initial elevator installation, and may be re-set during subsequent elevator servicing. To set NTSD values, a normal high speed run is conducted into the terminal landings. As the car passes each vane, the CPU calculates an NTSD value based upon the normal speed control value plus some margin, as described further below.

Thereafter, during normal elevator operation, as the car passes each NTSD vane, the DSP fetches the NTSD speed from a lookup table, and generates a time based speed profile curve having a predetermined deceleration rate, which is greater than the normal deceleration rate. More particularly, as shown in FIG. 1, which is a plot of dictated speed versus time, the speed values derived from the NTSD lookup table produce a stepped profile. A smoothing filter, however, produces an NTSD pattern based on an interpolated speed profile, which decreases linearly until the speed value has reached the NTSD speed of the next vane. The NTSD speed will remain constant until the car reaches the next vane, whereafter the NTSD speed will again start to decrease, at the predetermined deceleration rate, until the NTSD speed for the subsequent vane is reached. The NTSD system is designed so that the NTSD speed reaches the velocity for the next vane prior to the time the car would reach the next vane under normal conditions.

Each time a speed signal is received from the CPU, the DSP compares the dictated signal with the corresponding NTSD speed, taken from the interpolated speed profile curve, and outputs the lower of the two values as a speed control signal to the motor control static drive. Thus, if the speed value requested by the CPU is higher than the NTSD value, the NTSD system "clamps" the speed at the NTSD limit.

If the speed signal from the CPU exceeds the NTSD speed value, it means that the car is travelling too fast to be stopped using the normal deceleration profile. As a result, the deceleration slope of the NTSD pattern must be steeper than the normal deceleration pattern in order to prevent the car from overshooting the terminal. The existing NTSD pattern is therefore both a certain amount greater than the normal pattern (to allow a margin of error), and has a steeper deceleration slope. A conventional design is based on NTSD default values at each vane which are 4% plus 15 fpm above the normal speed values. Between vanes, the NTSD pattern has a deceleration slope which is 10% greater than the normal pattern deceleration slope. All three of these parameters are adjustable to use values other than the defaults.

There are a number of drawbacks with conventional NTSD systems, which complicate the adjustment of the system for proper operation. Examples will be discussed in connection with FIGS. 2–5.

First, jobs that use a reduced-stroke buffer employ an Emergency Terminal Speed Limiting device (ETSL). The ETSL device is activated in the event that the car is approaching the upper or lower terminal landing, and neither the normal speed control nor the NTSD system have slowed the car sufficiently to stop at the landing.

As shown in FIG. 2, there is a time lag between when the controller dictates a speed and when the motor actually reaches such speed. Therefore, during deceleration the actual motor speed will be higher, at any given moment, than dictated speed. Although NTSD dictated speed is substantially less than the ETSL limit, the margin between actual car speed and ETSL is much smaller. As a result, the car velocity can temporarily exceed the ETSL pattern limit during a normal NTSD backup pattern slowdown, which would activate the ETSL system and shut the car down. To avoid interference between the NTSD and ETSL systems, the margin between the NTSD and normal system must be kept sufficiently small. However, this is difficult to do without causing nuisance clamping of the normal slowdown pattern by the NTSD pattern.

Second, as shown in FIG. 3, since the NTSD pattern is a time based integrator with a fixed rate of change, if the NTSD system has too few hoistway vanes for a proper setup, the setup attempt produces a learned pattern that has too large a top NTSD step, resulting in an NTSD that cannot "catch" the subsequent steps. Thus, as shown in FIG. 3, when the car passes the first vane $V_1$, the NTSD speed begins to decrease at the specified deceleration rate. However, the NTSD speed for the next vane $V_2$ is so much less than $V_1$ that, when the car reaches vane $V_2$, the NTSD speed has not yet decreased to the $V_2$ velocity. A car that follows such an NTSD pattern will therefore be travelling well above normal speed for most of the slowdown, and is likely overshoot the terminal landing and reach the final limit switch, which shuts down the car.

Third, as shown in FIG. 4, where the terminal vane placement is not ideal for the given elevator speed and deceleration rate, the NTSD backup pattern will clip the normal pattern during the jerk into deceleration. As shown in FIG. 4, as the car passes vane $V_1$, the NTSD speed follows a constant deceleration rate, until it reaches the $V_2$ speed, whereupon it remains at the $V_2$ speed until reaching vane $V_2$. However, vanes $V_1$ and $V_2$, which are located in the region where the car jerks into deceleration, are too far apart. The result is that the NTSD speed value is lower than normal car speed during part of the elevator travel between vanes, resulting in unwanted clipping of the normal slowdown pattern.

Fourth, the NTSD curve is calculated assuming a normal travel time between two vanes during a high speed run. However, where the elevator executes a one-floor run, at the point where the car jerks into deceleration, it is not travelling at rated speed, and the travel time between vanes is greater than normal. As shown in FIG. 5, this means that the NTSD speed decreases to the speed for the next vane before the car has actually reached the next vane and, as in the case of FIG. 4, the NTSD deceleration profile is partly a stepped curve. As the car jerks into deceleration mode, the car is decelerating at a deceleration rate less than the NTSD curve. On certain speed and deceleration rate combinations, the two patterns converge, causing an unwanted NTSD clamping of the normal pattern.

Therefore, much trial-and-error work may be required to make the existing NTSD system work around these problems, thus increasing installation and servicing costs.

SUMMARY OF THE INVENTION

The present invention is an elevator having a normal terminal stopping device that is easier to adjust, is less likely to interfere with the normal stopping, and is less likely to cause the emergency terminal speed limiting device to be actuated.

More particularly, an elevator system according to the invention comprises a car, a plurality of landings including upper and lower terminal landings, a motor/drive means for moving the car between landings, a central processing unit ("CPU") for generating speed request signals including a normal car deceleration profile, and a drive control means for generating speed control commands and supplying the speed control commands to the motor/drive means.

The drive control means includes a Normal Terminal Stopping Device ("NTSD") comprising means for supplying signals representing the absolute car position of the car when the car is within a predetermined terminal landing zone; means for generating a maximum allowable NTSD speed profile for various car positions in the terminal landing zone during deceleration; and means, responsive to receiving a speed request signal from the CPU, for comparing the NTSD speed value to the speed request signal and outputting the lower value as a speed command signal to the motor/drive means.

The invention comprises the improvement wherein, rather than a single NTSD pattern, the NTSD control includes an NTSD monitoring speed profile and an NTSD violation speed profile. During normal car runs, the NTSD system monitors proper terminal stopping using the NTSD monitoring speed profile. If, however, the DSP receives a speed request signal in excess of the NTSD speed profile value, the system substitutes the NTSD speed profile, and also switches to an NTSD violation speed profile for deriving subsequent NTSD speed values. The NTSD violation profile has a steeper deceleration slope than the normal profile.

In accordance with a further aspect of the invention, the NTSD pattern is calculated based upon a theoretical constant deceleration during the jerk-into deceleration phase, based upon the same slope as the constant deceleration portion of slowdown.

In accordance with a further aspect of the invention, the NTSD system simulates additional NTSD speed pseudo checkpoints between the actual vanes, and forms the NTSD monitor pattern with these additional checkpoints. Velocity encoder signals are used to estimate car position, and the NTSD system calculates when the car passes the pseudo checkpoints.

When the elevator is initially installed, the backup NTSD pattern must be learned by the elevator motion control software. During initial installation, and thereafter when desired, the CPU car software can be commanded to enter a "learn" mode. Then the elevator performs a normal run toward each terminal landing. As terminal vanes are passed the DSP reports the vane identity to the CPU. The CPU software samples its normal speed dictation signals at each vane, and adds the appropriate margin to compute the desired NTSD backup pattern velocity at that vane. These NTSD vane velocities are stored in a non-volatile memory in the CPU, and are uploaded to the DSP upon power up, and whenever they are relearned. These velocity tables form the backup NTSD pattern that the DSP enforces on all subsequent terminal slowdown runs.

This invention is a modification to the controller software that learns and enforces the backup NTSD pattern. The new NTSD pattern provides better terminal slowdown protection, but also can be used without nuisance clamping during normal operation.

During the monitor mode the NTSD deceleration rate is the same as the normal slowdown deceleration rate so that the patterns do not converge. This allows the margin between the primary and backup terminal slowdown patterns to remain small. Violation mode is triggered whenever the primary slowdown pattern violates the backup NTSD slowdown pattern. During violation mode, the pattern is adapted to a 10% steeper deceleration rate than the normal rate used during the monitor mode. This steeper deceleration, plus the reduced margin between normal and backup patterns, helps prevent the elevator from encroaching onto an ETSL pattern during an NTSD slowdown. It also will compensate for the car having traveled further into the terminal from its normal pattern before violating the NTSD monitoring pattern, providing the necessary recovery from the violation for the NTSD system to make a controlled stop without overshooting the terminal. The violation pattern is produced by increasing the deceleration rate of the NTSD monitor pattern, preferably by about 10%, over the normal deceleration rate.

The improved NTSD system is less prone to nuisance clamping and less prone to encroaching into the ETSL system during a backup pattern slowdown. It also makes the NTSD system easier to install without the necessity of fine tuning as in existing systems.

For a better understanding of the invention, reference is made to the following detailed description of a preferred embodiment, taken in conjunction with the drawings accompanying the application.

DETAILED DESCRIPTION OF A PREFERRED EMBODIMENT

Figure 6:
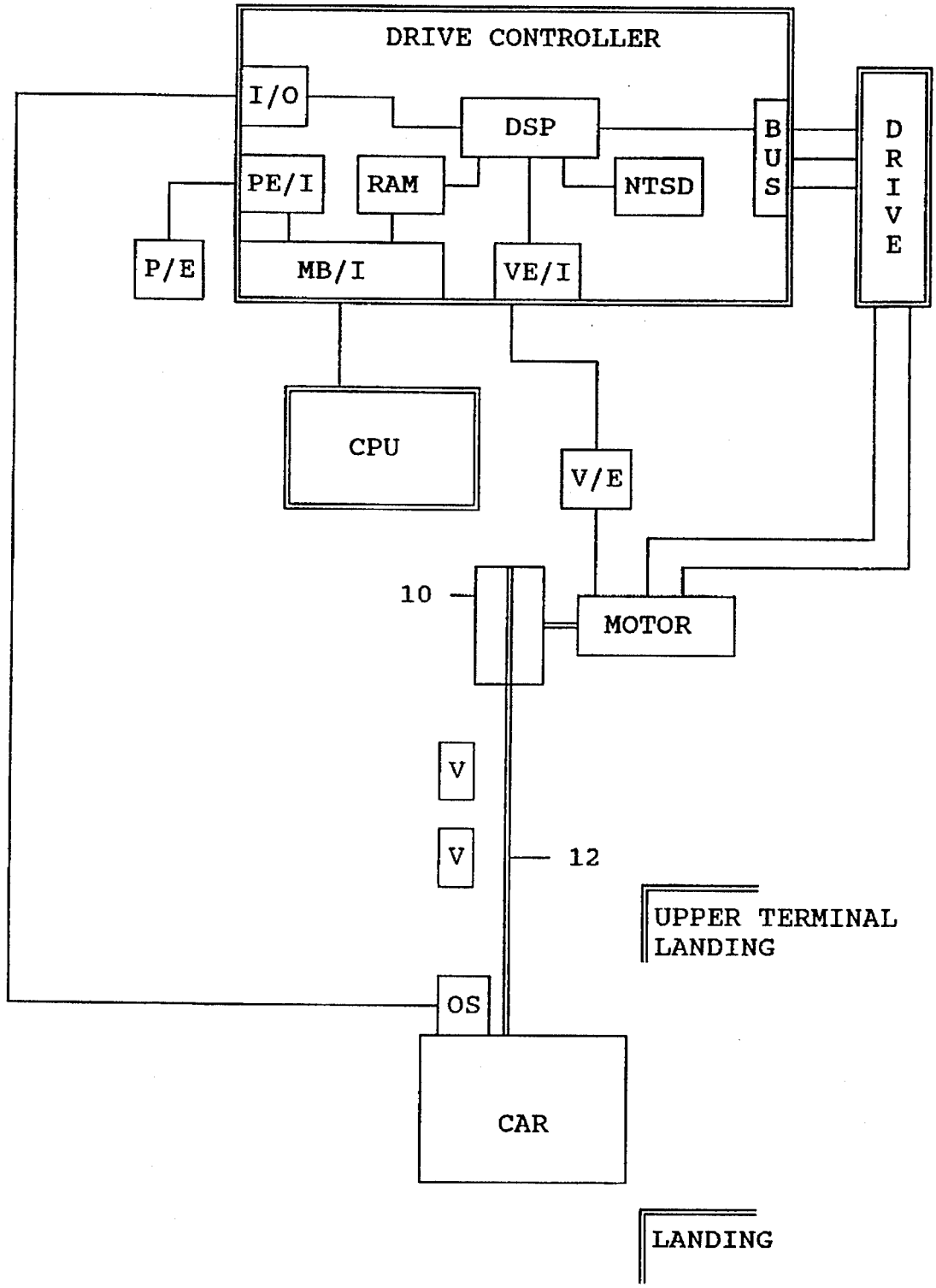
FIG. 6 is a block diagram of an elevator control system according to the invention.

Referring to FIG. 6, an elevator system includes a central processing unit ("CPU") for supplying speed control requests, and a Drive Controller which generates speed control signals and outputs such signals to a static drive. The static drive, in turn, provides an appropriate voltage and, in the case of ac motors, frequency to a motor to control motor speed.

The motor, which may be either geared or gearless, rotates a drive sheave 10. A rope 12, which supports an elevator car and counterweight (not shown), is entrained over the sheave, such that rotation of the motor and sheave raises or lowers the car between a series of landings, including an upper terminal landing and a lower terminal landing (not shown).

The Drive Controller senses elevator position and velocity using a position encoder "P/E", which is mounted on the speed governor. Based upon these position signals, the CPU computes a time-based or position-based velocity command profile for the elevator to follow. The position encoder P/E data required by the CPU is maintained in the DSP's position encoder interface "PE/I", and is read by the CPU via the multibus interface "MB/I" on the DSP card.

The CPU may, for example, be an Intel 80C186 CPU. The computed velocity profile is sent from the CPU to the Drive Controller, which includes a speed control computer card containing a digital signal processor, for example a Texas Instruments model TMS320C26 DSP (labelled "DSP" on FIG. 6). The DSP conditions the speed profile, as described below, and generates speed control signals which are sent to the elevator drive, e.g., an MG, SCR, or VVVF drive. The DSP also monitors drive operation. The CPU has some safety related signals that are sent to the drive, but the DSP forms the primary interface with the drive.

The elevator further includes a series of terminal hoistway vanes, (two of which, vanes "V", are shown for illustration purposes in FIG. 6), mounted in the terminal landing zone, which represent a series of checkpoints of actual car position. The vanes are detected by an optical sensor "OS" on the car, which reads the vane identification and provides such information to the DSP. The elevator also includes a velocity encoder V/E, which is coupled to the motor. Velocity encoder signals are provided to the DSP through a velocity encoder interface VE/I.

Any data to be exchanged between the CPU and DSP is contained in a dual ported RAM and accessed by the CPU via the multibus interface MB/I. This includes the vane identifications reported from the DSP to the CPU, velocity commands sent by the CPU to the DSP, and learned NTSD tables sent by the CPU to the DSP and stored in memory labelled NTSD in FIG. 6. After the DSP has applied any necessary NTSD clamping, the drive velocity command is sent from the DSP to the drive on the parallel interface bus "BUS".

The foregoing hardware is the same as used in the Traflomatic IV elevator system manufactured by Dover Elevator Systems, Inc., and therefore need not be described in further detail. Such hardware, or any other suitable hardware components, may be employed in connection with the present invention.

Operation of the NTSD System

Figure 7:
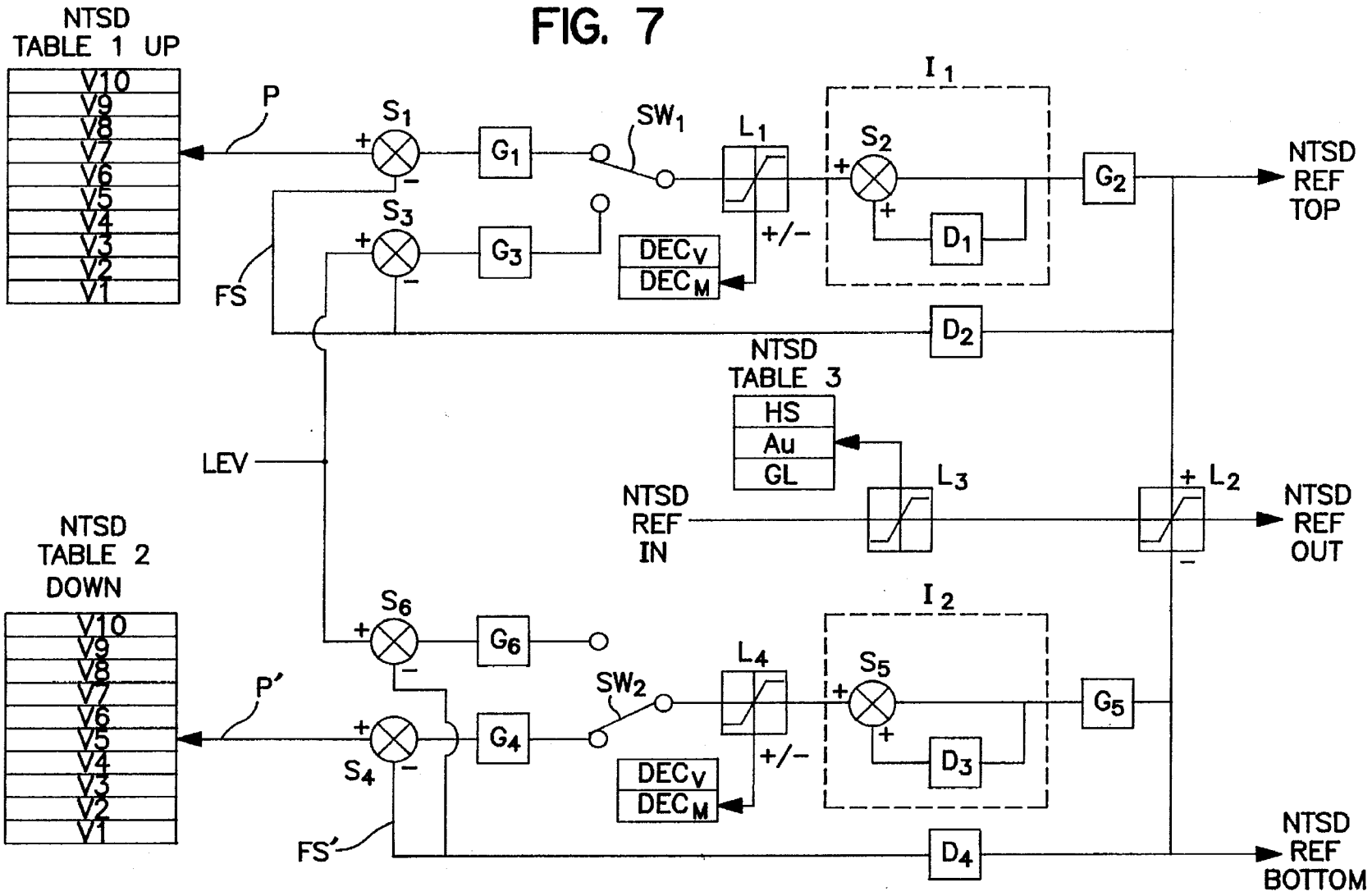
FIG. 7 is a block diagram of the NTSD system.

The exemplary embodiment of an NTSD system, which is shown in somewhat simplified form in FIG. 7, utilizes the hardware components used in the Traflomatic IV elevator system, which is manufactured by Dover Elevator Systems, Inc., and performs, in addition to the function of signal limiting at the terminal floors, the function of signal limiting between floors, as described further below. FIG. 7 represents the state of the NTSD system during an approach to the terminal landing, prior to the elevator initiating final slowdown and stopping.

The NTSD system includes three NTSD lookup tables, labelled NTSD Table 1, NTSD Table 2, and NTSD Table 3 in FIG. 7. NTSD Tables 1 and 2 are used for speed control at the upper and lower terminal landings, respectively, and NTSD Table 3 is used for limiting maximum speed during elevator runs.

NTSD Table 1 contains a series of stored velocity values, e.g., V1–V10, representing NTSD speeds for ten vane checkpoints, and which are accessed by pointer "P". NTSD values are sent to a summer $S_1$, which also receives a feedback signal FS, to produce an error signal, which is amplified in a gain element $G_1$, and fed to a symmetrical limiter $L_1$. Limiter $L_1$ also receives one of two limiting signals, $DEC_M$ or $DEC_V$. The value $DEC_M$ represents a predetermined deceleration value during "monitor" mode of the NTSD system, whereas $DEC_V$ represents a predetermined deceleration value during the "violation" mode of NTSD operation. Preferably, $DEC_M$ is the same as the normal deceleration rate of the elevator, whereas $DEC_V$ represents a value which is higher, e.g., 10% higher, than the normal deceleration rate.

Assuming that the error signal from gain element $G_1$ is greater than $DEC_M$ (or $DEC_V$, when in violation mode), the limiter $L_1$ limits the output signal to $DEC_M$ (or $DEC_V$). The output signal is fed to a summer $S_2$, which also receives a feedback signal from delay element $D_1$. The delay element acts as a storage device to hold the input value from a calculation cycle for the subsequent calculation cycle. The output from the delay element is the input to the delay element delayed by one calculation time interval. The output from summer $S_2$ is amplified in gain element $G_2$, and through a delay element $D_2$ provided as feedback signal FS to summer $S_1$. The output from gain element $G_2$, which is designated NTSD REF TOP, is also fed to an asymmetrical limiter $L_2$ (described further below), which outputs an NTSD output signal designated NTSD REF OUT on FIG. 7.

In operation, when the car encounters a terminal vane, an NTSD value, e.g., $V_7$, is fed to summer $S_1$ from Table 1. $V_7$ represents the maximum desired speed of the car when it reaches the next terminal vane. Because feedback signal FS is at the higher speed value of the prior vane ($V_8$), an error signal, representing the difference between $V_8$ and $V_7$, is generated and fed to the limiter $L_1$. Initially, such error signal will exceed $DEC_M$, and therefore the value $DEC_M$ will be fed to summer $S_2$, representing the NTSD deceleration rate desired for the system. This error signal is then integrated in integrator $I_1$ (comprising summer $S_1$ and $D_1$) until equilibrium is reached via the negative feedback path from gain element $G_2$ to input summer $S_1$. In this manner, the NTSD speed will decrease linearly to speed $V_7$, and remain at $V_7$ until the next vane ($V_6$) is encountered, whereupon the value $V_6$ replaces $V_7$ as the input to summer $S_1$ and the process is repeated.

In the event that the system switches from monitor mode to violation mode, the deceleration value fed to limiter $L_1$ changes from $DEC_M$ to $DEC_V$. As a result of the higher value of $DEC_V$, the output from $G_2$ decreases more rapidly, causing a faster reduction in the NTSD REF OUT speed signal, causing the car to decelerate more rapidly (preferably, at a rate 10% greater than the normal rate of deceleration).

When the car is moving in the down direction, the same NTSD control occurs, except that the values in Table 2 (which may differ from Table 1) are used, accessed by pointer P'. Values from Table 2 are fed to a summer $S_4$, gain element G4, and limiter L4, and the output from limiter is fed to an integrator $I_2$, comprising summer $S_5$ and delay element $D_3$, and amplified in gain element $G_5$. The output, which is designated NTSD Ref Bottom, is provided to limiter $L_2$, whose output is NTSD REF OUT.

A second reference input LEV provides a minimum leveling speed at the terminal floor. Signal LEV is provided to a summer $S_3$ or $S_6$, which also receives feedback signal FS or FS', and through gain element $G_3$ or $G_6$ to switch $SW_1$ or $SW_2$. Transfer from Table 1 or 2 values to LEV is automatically performed by the filter when the leveling speed error output from gain element $G_3$ or $G_6$ is less than the high speed error from gain element $G_1$ or $G_4$. When the gain coefficient of gain elements $G_3$ and $G_6$ are set to the same value as the leveling transition gain parameter ("LTG"), which is the programmed amount of rounding from constant deceleration into leveling, the transfer will occur at the speed level where LTG would normally cause the speed demand to switch from constant deceleration to constant position error gain operation.

When the elevator is between floors, the NTSD system also limits run speed in accordance with elevator operating condition. Three maximum speed values are stored in Table 3, representative of maximum desired speed during high speed operation HS (i.e., normal runs), inspection mode AU, and door open mode GL. The normal NTSD REF IN signal, which is the normal speed dictation pattern sent by the CPU, is fed to limiter $L_3$, which limits the output signal to the values of HS, AU, or GL, depending on elevator operating mode. As shown, signals from Integrator $I_1$, $I_2$, and $L_3$ are all fed to limiter $L_2$, which outputs signal $L_3$ to NTSD REF OUT signal unless signal $L_3$ is greater than the $I_1$ signal in the positive direction (up), or less than the $I_2$ signal in the negative direction (down) When either $I_1$ or $I_2$ signals are exceeded, the NTSD REF OUT signal is set to $I_1$ or $I_2$ accordingly.

NTSD REF IN is a signed binary number. Positive numbers correspond to travel in the UP direction, whereas negative numbers correspond to travel in the DOWN direction. The operation of the asymmetrical limiter is such that the profile generated from the UP NTSD Table 1 limits only positive NTSD REF IN values, and the profile generated from the DOWN NTSD Table 2 limits only negative NTSD REF IN values.

Figure 8:
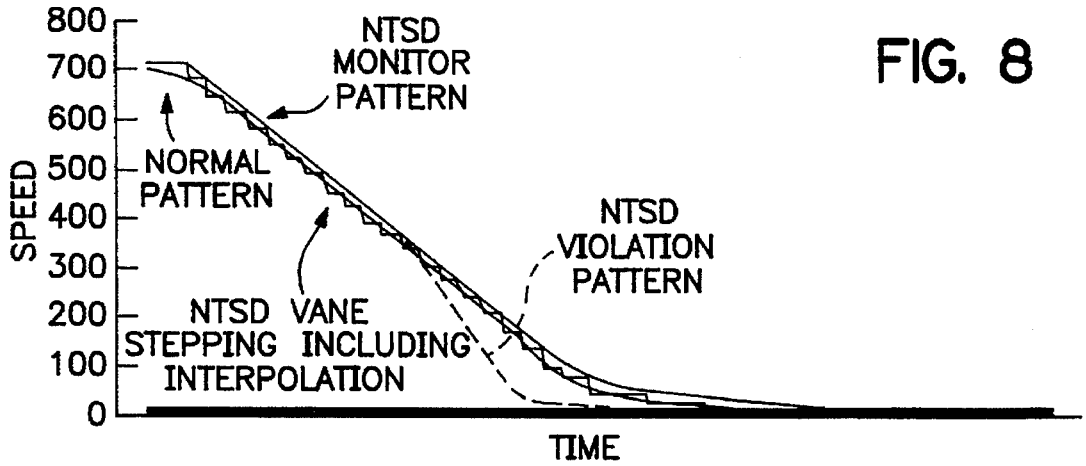
FIG. 8 is a graph of an NTSD slowdown monitoring pattern according to the invention.

Referring to FIG. 8, except in the transition region between constant speed and deceleration (the jerk-into-deceleration portion of the speed profile curve) and in the region approaching zero speed, the NTSD value at each vane represents the corresponding normal speed value plus a constant value as an offset. Accordingly, the NTSD pattern has the same slope as the normal deceleration profile. Also, compared to known NTSD systems, the difference between NTSD and normal speed values is relatively small, preferably 15 fpm.

Proper NTSD operation depends upon proper detection of terminal vanes by the DSP. As an independent verification, the DSP reports vane identities to the CPU as vanes are passed. The CPU verifies proper vane detection by anticipating a vane identity countdown as the terminal is approached, and an identity countup upon departing the terminal. An incorrect sequence detected by the CPU results in the elevator being parked at a floor, with no further runs allowed.

Figure 9:
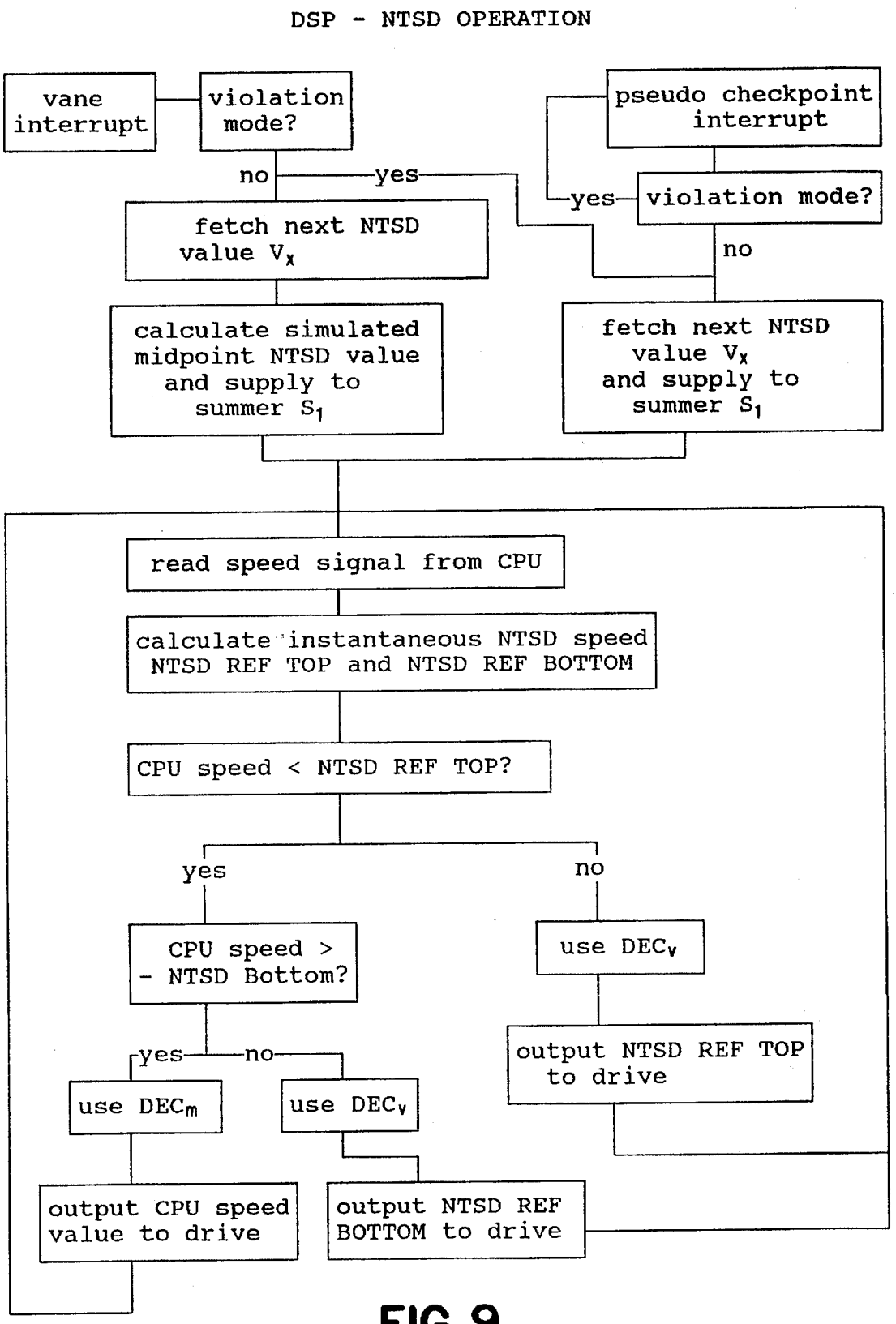
FIG. 9 is a flow diagram of the NTSD operation during a car run.
Figure 13:
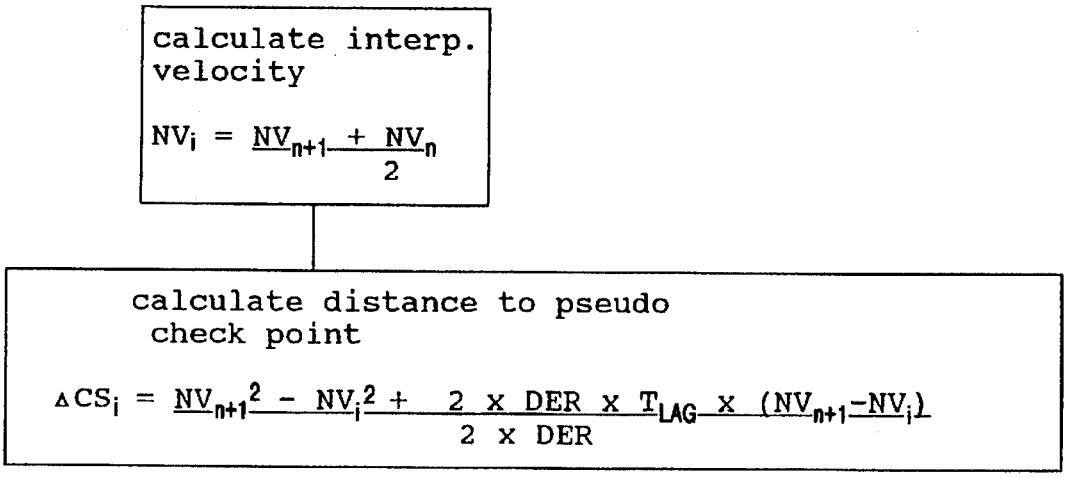
FIG. 13 is a flow diagram of the calculation of the interpolated velocity and the distance to the pseudo check point.
Figure 14:
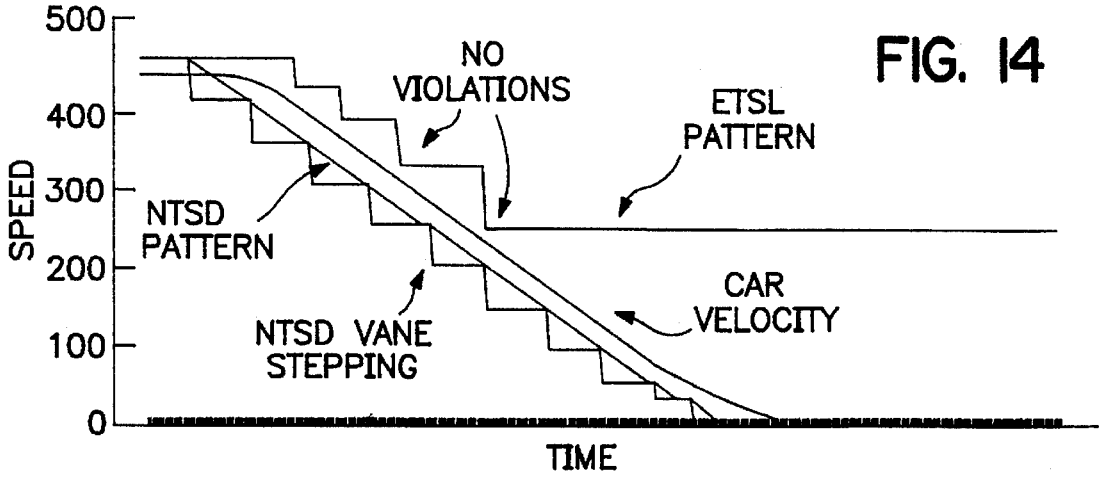
FIG. 14 is a graph of an NTSD slowdown monitoring pattern showing resulting car speed.

The operation control of the NTSD system is shown generally in FIG. 9. During elevator runs, the NTSD system operates in one of two modes: monitor or violation. During the monitor mode, the NTSD system monitors the normal speed control signals using the NTSD pattern shown in FIG. 8. Referring to FIG. 9, when the car passes a vane, the DSP fetches the next NTSD speed value $V_X$. Although the speed value may be applied directly as an input to summer $S_1$ or $S_4$, preferably the DSP calculates a simulated midpoint NTSD value, which is the NTSD speed value at a pseudo checkpoint midway in time between the current vane and the next vane, and supplies this to summer $S_1$ or $S_4$ as the NTSD value. This process is described further on in connection with FIG. 13. When the car passes the pseudo checkpoint, the actual NTSD value for the next vane is then supplied to the summer $S_1$ or $S_4$ as the NTSD value.

Referring again to FIG. 9, when a speed control signal is received from the CPU, the DSP reads the NTSD REF TOP signal (representative of the instantaneous NTSD speed, calculated as a function of the time which has elapsed since passing the last vane). Assuming the CPU generated speed value is less than the NTSD value, the DSP reads the NTSD REF DOWN signal. If the CPU generated speed value is also less than the NTSD value, the NTSD system does not interfere with normal operation. Accordingly, the NTSD system outputs the CPU dictated speed value to the motor drive as the speed signal (NTSD REF OUT). Also, the NTSD system uses $DEC_m$ (the deceleration value for the monitor mode, which is preferably the same as the normal deceleration rate) to calculate further NTSD speed values.

Should the CPU speed value exceed the NTSD REF TOP or BOTTOM value, the NTSD system clamps the speed to the NTSD pattern, and the DSP outputs the lower, NTSD value (NTSD REF TOP or NTSD BOTTOM), as the speed control command NTSD REF OUT to the drive. In addition, the NTSD system changes from the monitor mode to the violation mode, in which the NTSD pattern has a steeper deceleration rate $DEC_V$ than the normal $DEC_M$. When the next speed signal is received from the CPU, rather than an NTSD value based on the normal pattern, the NTSD REF TOP and BOTTOM signals will be the violation NTSD values.

The violation NTSD pattern has a deceleration slope which is 10% greater than the normal deceleration slope, as shown in FIG. 8. The NTSD system will continue in the violation mode until just before the elevator reaches the landing (at which time separate landing software control takes over, in a known manner). Should the CPU speed values fall below the violation NTSD values prior to reaching the landing, the system will output the CPU speed value and return to the monitor mode.

The margin between the NTSD speed values and the normal speed is selected so that, if the elevator is operating normally, the CPU speed signal will be less than the NTSD value.

Calculation of the NTSD Table

Figure 10:
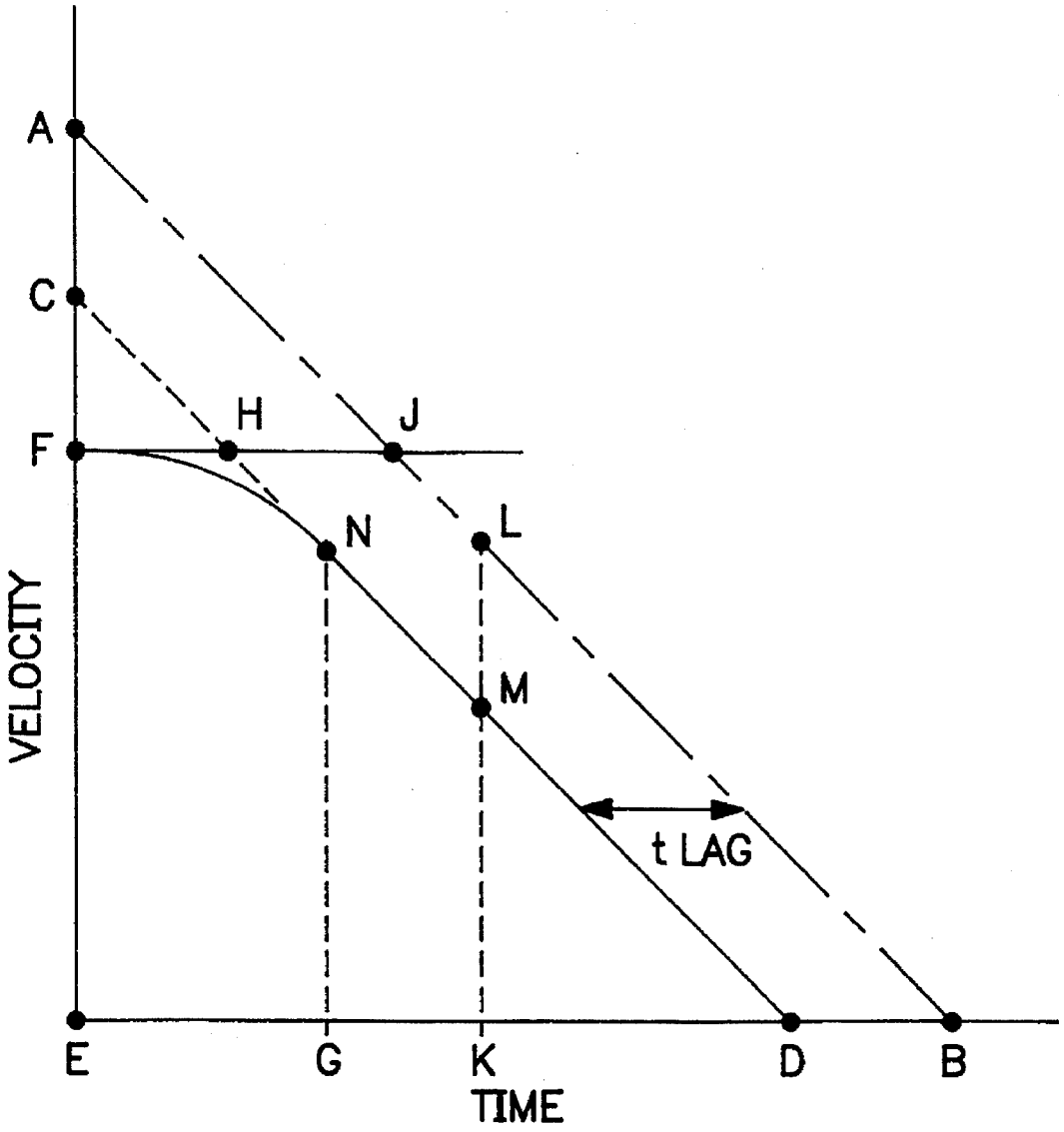
FIG. 10 is a graph showing dictated versus actual car speed during deceleration.

During a normal high speed run, as the car approaches the landing the car changes from constant velocity, at rated speed, to a constant deceleration. FIG. 10 shows a time-based slowdown curve, where line F-D represents the velocity dictated by the controller, and line L-B represents the constant deceleration portion of actual car velocity. The value "$t_{LAG}$" represents the tracking time delay. Line A-B represents theoretical car velocity versus time for a constant deceleration from a speed higher than contract speed, and line C-D represents the theoretical speed dictation required to make the car track line A-B. Both lines A-B and C-D have a constant deceleration, "a".

As the car is decelerating, it passes NTSD vanes in the hoistway. Some vanes will be passed while the controller is dictating the jerk-in portion, line F-N, prior to time G. Other checkpoints will be passed after time G when the controller is dictating constant deceleration, line ND.

In accordance with invention, the NTSD values, during the jerk-in portion of velocity dictation, are based upon a theoretical speed dictation pattern, line C-D, which has the same deceleration rate "a" as the constant deceleration portion of the curve N-D, rather than actual speed dictation line F-N. This will simplify the NTSD pattern to be a constant deceleration pattern.

Figure 11:
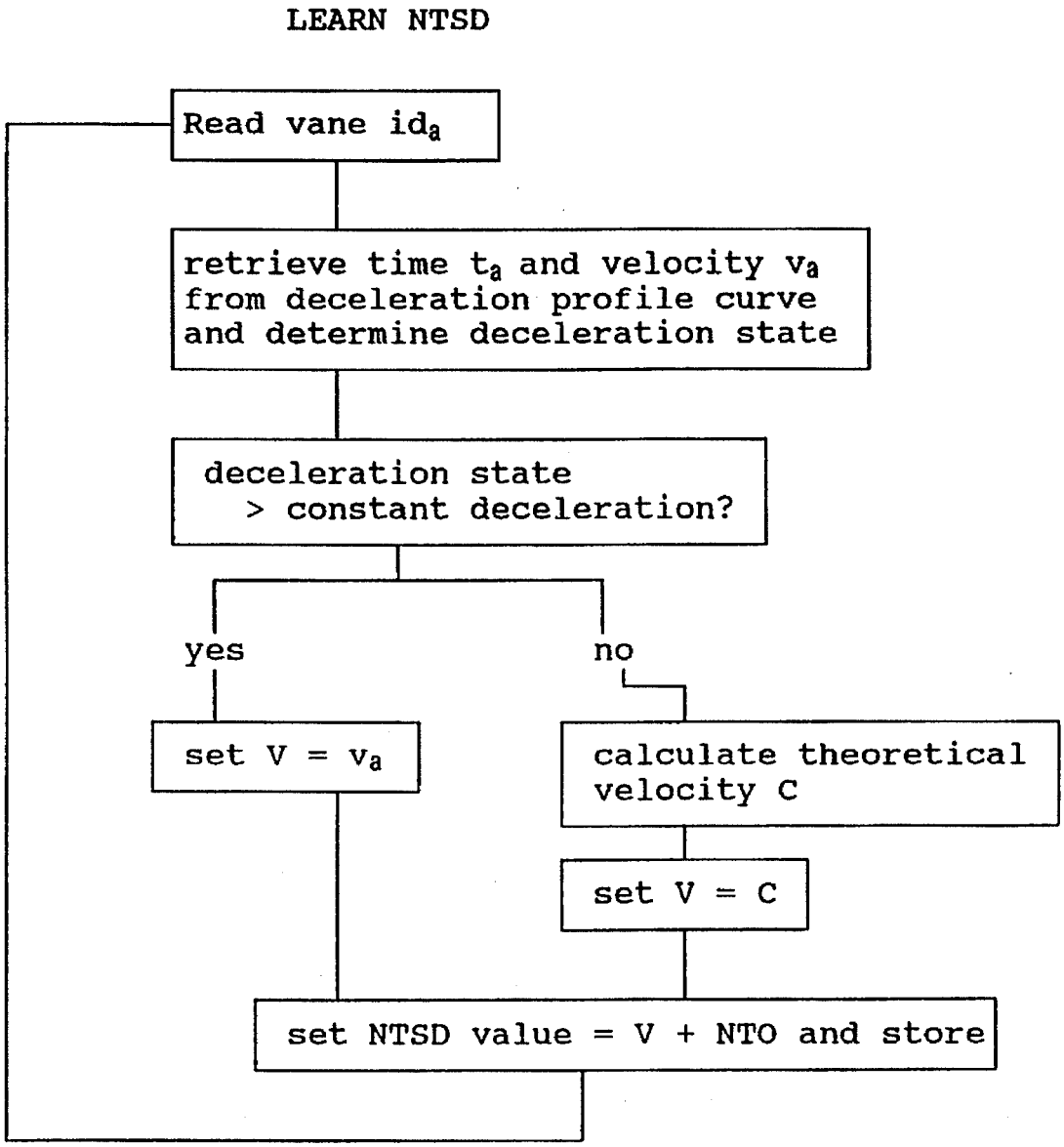
FIG. 11 is a flow diagram of the process employed by the CPU to calculate the NTSD table.
Figure 12:
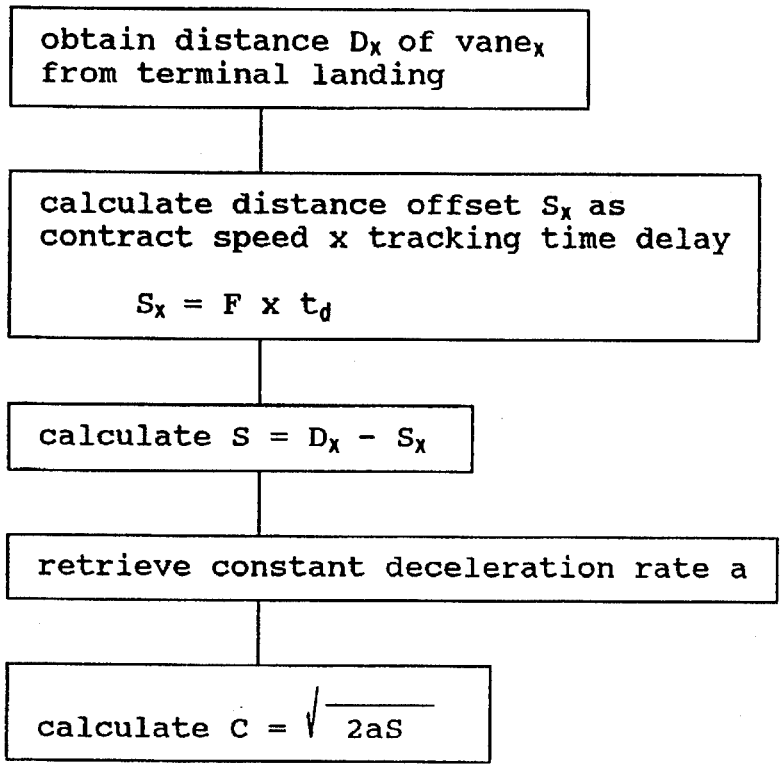
FIG. 12 is a flow diagram of the calculation of NTSD values for the jerk into deceleration portion of car travel.

In order to calculate the NTSD value table, the elevator is placed in a "learn" mode, and a high speed run is conducted in the normal manner. Referring to FIGS. 10–11, after the elevator has passed time "G", the NTSD value is calculated simply by adding a constant to the actual speed dictation signal. Prior to reaching constant deceleration, i.e., in the jerk-into deceleration region F-N, the NTSD values are based on a constant offset from the theoretical speed dictation line C-N. The algorithm set forth in FIG. 11 is used to determine NTSD values.

As a hoistway vane is passed, the CPU fetches its distance from the terminal landing. This distance corresponds to the area under the velocity-time curve. For example, if a vane is passed at time E, the distance is the area enclosed by triangle ABE (see FIG. 10).

The square law area under the theoretical speed dictation curve is then calculated. This is the area enclosed by the triangle CDE:

$$\text{Area } CDE = \text{Area } ABE - \text{Area } ABCD$$

However, "C" is not yet known. To calculate "C", the area ABCD is assumed to be approximately the same as area JBDH, where JBDH=velocity $F \times t_{Lag}$. This approximation is sufficient because velocity F is much larger than the velocity difference (A–F). Thus, $$S = \text{Area } ABE - \text{Area } JBDH$$

and $$\text{velocity } C = \sqrt{2aS}$$

Once "C" is determined, the NTSD velocity is determined by adding the predetermined velocity margin "NTO". Therefore, for time E, the NTSD velocity=C+NTO.

For vanes encountered after time G, the point at which the CPU speed generator determines that the jerk into deceleration is complete (i.e., deceleration=a), and the dictation is in a constant deceleration mode, the desired NTSD velocity is simply calculated as present dictation plus NTO. The determination of a theoretical dictation point (such as "C") is not necessary, since it corresponds to the actual dictation value.

NTSD Interpolation

Due to the reduced spacing between the normal dictation pattern and the NTSD backup pattern, the NTSD system may interfere with the normal system during short runs into the terminal floor, during the time the normal pattern is changing from the peak speed into the constant deceleration region of operation. As discussed above, the backup pattern filter algorithm integrates in time between the speed table entries which were learned during the NTSD setup procedure. Due to the slower elevator speed, the backup pattern reaches the checkpoint speed level early in time, which effectively moves the backup pattern closer to the normal pattern.

A solution to this problem would be to install more hoistway vanes, with closer spacing. This is undesirable due to the extra costs involved. According to the present invention, the NTSD system simulates extra vanes, during the monitor mode, using an interpolation algorithm.

When a vane is encountered, the NTSD system calculates an NTSD velocity for a point midway in time to the next actual vane, as follows:

$$NV_i = \tfrac{1}{2}(NV_{n+1} + NV_n)$$

where, $NV_i$ is interpolate velocity $NV_n$ is the checkpoint (vane) velocity $NV_{n+1}$ is next higher checkpoint velocity The value of $NV_i$ is provided to the NTSD smoothing filter ($S_1$ or $S_4$ in FIG. 7), in place of the next actual vane velocity ($NV_{n+1}$), for use in calculating the speed profile. When the elevator passes this pseudo checkpoint, the next actual checkpoint velocity $NV_{n+1}$ will be provided to the smoothing filter.

Because there is no vane in the hoistway corresponding to the pseudo checkpoint, the DSP needs to estimate when the car has passed the checkpoint, so as to signal a vane interrupt. It utilizes the signals from the velocity encoder (FIG. 6) to do so, using the following equation:

$$\Delta CS_i = \frac{CV_0^2 - CV_i^2}{2DER}$$

where, $\Delta CS_i$ is estimated car displacement from the checkpoint;

$CV_0$ is initial estimated car velocity $CV_i$ is interpolated estimated car velocity; and DER is the deceleration rate The checkpoint velocities learned during the NTSD system setup include an offset to separate the backup pattern from the normal pattern by a fixed amount. The normal pattern also leads the car velocity by a fixed time interval in a typical installation. With these two factors taken into consideration, the equations relating car velocities to checkpoint velocities are $$CV_0 = (NV_{n+1} - NTO) + DER \times T_{LAG}$$

$$CV_i = (NV_i - NTO) + DER \times T_{LAG}$$

where

NTO is the margin between normal and NTSD speed $T_{LAG}$ is the time lag from the speed command to when the car reaches such speed Substituting these values into the equation for the car displacement, $$\Delta CS_i = \frac{(NV_{n+1} - NTO)^2 - (NV_i - NTO)^2 + 2 \times DER \times T_{LAG} \times (NV_{n+1} - NV_i)}{2 \times DER}$$

Neglecting the NTO term:

$$\Delta CS_i = \frac{NV_{n+1}^2 - NV_i^2 + 2 \times DER \times T_{LAG} \times (NV_{n+1} - NV_i)}{2 \times DER}$$

Figure 1:
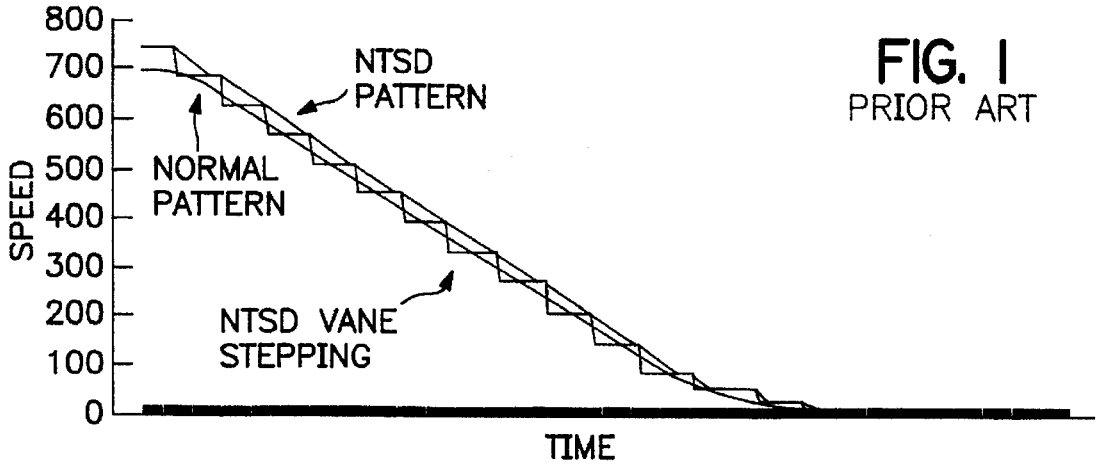
FIG. 1 PRIOR ART
FIG. 1 is graph of a prior art NTSD slowdown pattern.
Figure 2:
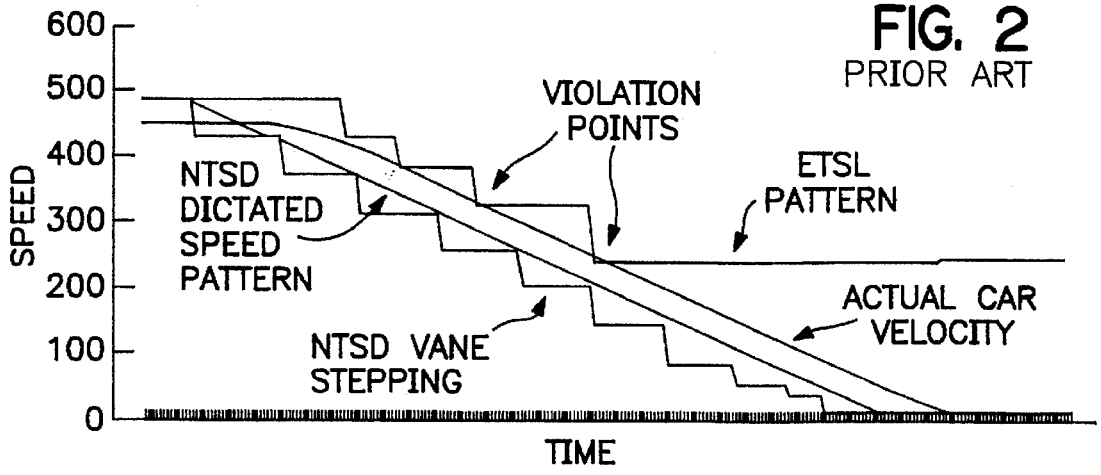
FIG. 2 PRIOR ART
FIG. 2 is a graph showing a prior art NTSD slowdown, in which actual car velocity violates ETSL.
Figure 3:
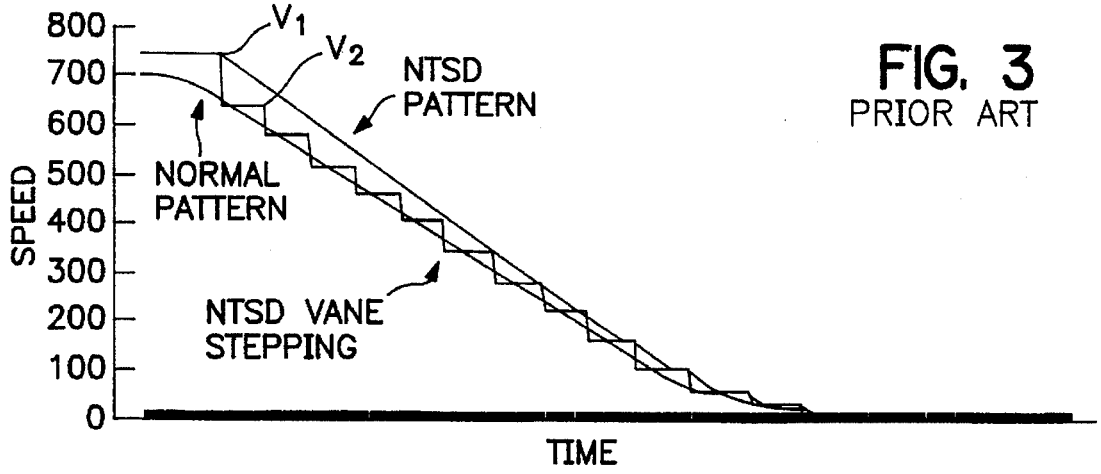
FIG. 3 PRIOR ART
FIG. 3. is a graph of a prior art NTSD slowdown pattern generated with too few vanes.
Figure 4:
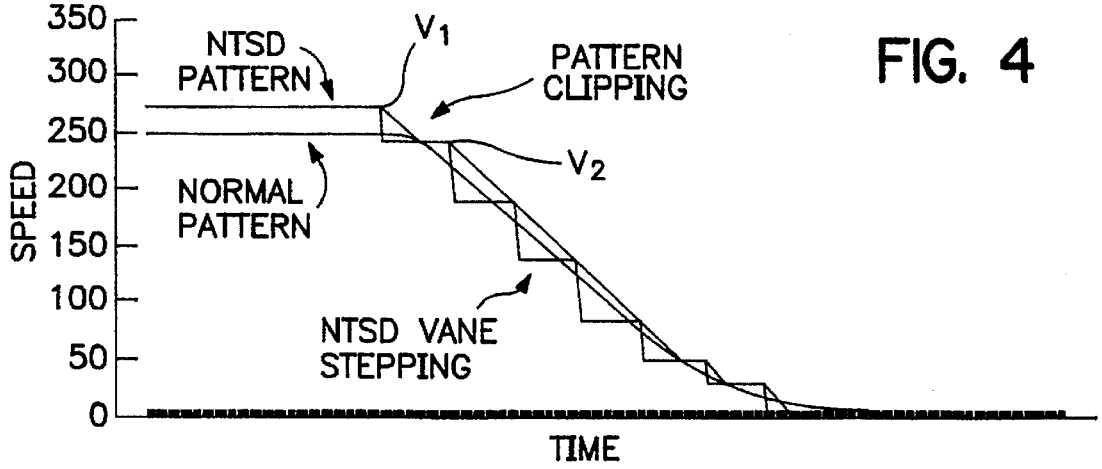
FIG. 4 is a graph showing a prior art NTSD system clamping a normal car slowdown.
Figure 5:
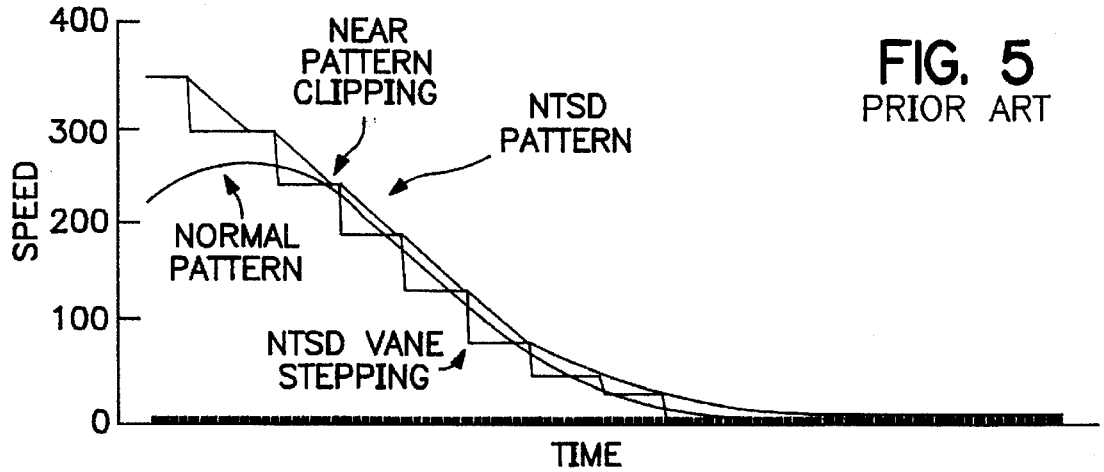
FIG. 5 PRIOR ART
FIG. 5 is a graph of a prior art NTSD system almost clamping a normal car slowdown during a one floor run.

The improved NTSD pattern prevents an occurrence of the problem shown by FIGS. 4 and 5, wherein the existing system has to be fine-tuned to prevent the NTSD pattern from clipping the normal speed dictation pattern as it jerks into deceleration. This invention includes an extrapolation calculation [previously described as calculation of the NTSD Table, p. 24] that converts checkpoint velocities that were learned during the jerk-into-deceleration region into checkpoint velocities that lie on a constant deceleration curve so that they never clip the normal dictation pattern.

Figure 15:
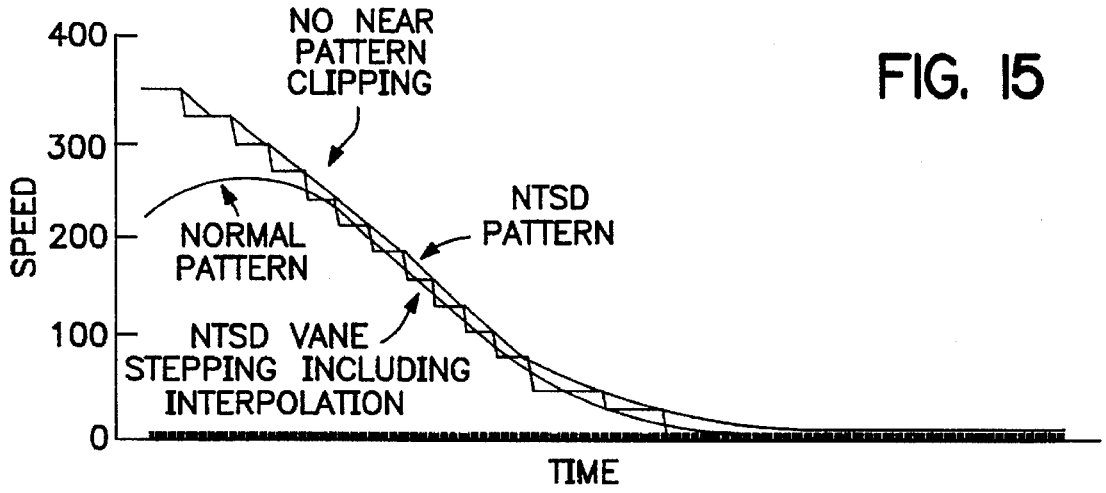
FIG. 15 is a graph showing a normal slowdown during a one floor car run with an NTSD slowdown pattern according to the invention.

Because the improved NTSD pattern synthesizes additional checkpoints in between the actual vane checkpoints as part of the NTSD monitor pattern, during a one floor run, nuisance clamping faults are less likely to occur. The DSP determines position using the velocity encoder, through interface VE/I. The type of run that causes this problem with the existing design is shown in FIG. 5, where, depending upon elevator tune-up, clamping can occur in the region where FIG. 5 shows near clamp. The vane synthesis solution is shown in FIG. 15. The vane synthesis is not used during the violation mode, only actual checkpoints are used for violation recovery.

The improved NTSD pattern is automatically adjusted to the number of checkpoints required so that the installer does not have to adjust the software to expect a given number of checkpoints. When the "learn" command is typed into the controller, the CPU sets a value MXV equal to or greater than the number of vanes needed in the hoistway for a proper installation. The proper initial value of MXV versus contract speed comes from a CPU software lookup table whose values were determined by simulation and testing. During the NTSD learn run, the value of MXV is reduced to the number of actual vanes encountered. The learn software attempts to learn the NTSD pattern using the actual vane count. When the car passes the hoistway mid-point in the up direction, the DSP is reporting a vane i.d. one greater than the actual vane count to the CPU. The CPU thus knows what actual vane count should be used for MXV prior to entering the top terminal, and will use this new value when learning both terminal NTSD patterns.

At the conclusion of the terminal scan runs, top and bottom NTSD table will have been built. A final check of each terminal pattern is made. If the hoistway contains enough checkpoints so that each terminal's NTSD pattern reaches all the way up to contract speed, then correct patterns have been built.

If too few vanes are present, such that the NTSD patterns fail to reach contract speed, then the software logs an error alerting the installer to the bad pattern. If the hoistway contains extra vanes that are not needed for the patterns, such that the patterns extend way beyond contract speed, then the extra top values of each pattern are discarded, and the MXV value is further reduced to match the reduced size of the required terminal patterns. The ignored vanes would then not be used during NTSD monitoring of car runs. The patterns saved away and used by the NTSD system will always appear to have been learned from exactly the number of vanes in the hoist way that are required, even if additional vanes are present.

As long as the hoistway is not lacking the required checkpoints, the system can self-adjust. If the hoistway lacks any required checkpoint, the system will log an error, rather that just save away a poor pattern.

The improved auto learning eliminates the requirement to accurately place vanes and profile adjustment in the field, thus saving labor expense.

The NTSD system learns the optimum profile regardless of the programmed speeds floor heights, or deceleration rates for both high speed and short runs into the terminal.

The foregoing represents a description of preferred embodiments of the invention. Variations and modifications will be evident to persons skilled in the art, without departing from the inventive principles disclosed herein. For example, while a preferred embodiment has been described in connection with a traction elevator, the invention could be utilized in other types of elevators, such as a linear motor-driven elevator. All such modifications and variations are intended to be within the scope of the invention, as defined in the following claims.

We claim:

1. In an elevator system comprising a car, a plurality of landings including upper and lower terminal landings, a motor/drive means for moving said car between landings, processor means for generating speed request signals, and a drive control means for generating speed control signals and supplying said speed control signals to said motor/drive means; and wherein said drive control means includes a Normal Terminal Stopping Device ("NTSD") comprising means for periodically determining absolute car position when said car is within a predetermined terminal landing zone; means for generating maximum allowable NTSD speed values for various car positions in said terminal landing zone during deceleration; and means, responsive to receiving a speed request signal from said processor mean, for determining an instantaneous maximum speed from said maximum allowable speed values and for supplying the lower of said instantaneous allowable maximum speed and said speed request signal as a speed control signal to said motor/drive means;

the improvement wherein said NTSD includes means for generating a monitoring speed profile for providing maximum allowable NTSD speed values during normal elevator operation; means, responsive to receiving a speed request signal in excess said maximum allowable NTSD speed, for generating a violation speed profile, for providing subsequent maximum allowable NTSD speed values, wherein said violation speed profile has a deceleration rate greater than that of said monitoring speed profile;

wherein said processor means generates speed request signals, in said terminal landing zone, having a predetermined deceleration slope, and wherein said monitoring speed profile has the same deceleration slope; wherein said NTSD includes a first NTSD table, representing stored NTSD values at predetermined distances from at least one of the terminal landings, and wherein said NTSD further comprises interrupt means for indicating that the car has reached a predetermined position, and means responsive to said interrupt means for retrieving a predetermined value from said first NTSD table.

2. An elevator system as defined in claim 1, wherein said first NTSD table represents stored NTSD values at predetermined distances from said top terminal landing, and wherein said NTSD further includes a second NTSD table, representing stored NTSD values at predetermined distances from the bottom terminal landing, and means responsive to said interrupt means for retrieving a predetermined value from said second NTSD table.

3. An elevator system as defined in claim 1, comprising a plurality of checkpoints in said terminal landing zones, for indicating absolute elevator position, means for generating speed signals representative of elevator velocity, wherein said NTSD includes means, responsive to retrieving a value from said NTSD table, for determining at least one pseudo checkpoint, lying at a predetermined location between checkpoints, means for determining an interpolated NTSD speed value for said pseudo checkpoint, and means, responsive to said speed signals, for determining when said car has reached said pseudo checkpoint and for using said interpolated NTSD speed value as the maximum allowable NTSD speed value.

4. In an elevator system comprising a car, a plurality of landings including upper and lower terminal landings, a motor/drive means for moving said car between landings, processor means for generating speed request signals, and a drive control means for generating speed control signals and supplying said speed control signals to said motor/drive means; and wherein said drive control means includes a Normal Terminal Stopping Device ("NTSD") comprising means for periodically determining absolute car position when said car is within a predetermined terminal landing zone; means for generating maximum allowable NTSD speed values for various car positions in said terminal landing zone during deceleration; and means, responsive to receiving a speed request signal from said processor means, for determining an instantaneous maximum speed from said maximum allowable speed values and for supplying the lower of said instantaneous allowable maximum speed and said speed request signal as a speed control signal to said motor/drive means;

the improvement wherein said NTSD includes means for generating a monitoring speed profile for providing maximum allowable NTSD speed values during normal elevator operation; means, responsive to receiving a speed request signal in excess said maximum allowable NTSD speed, for generating a violation speed profile, for providing subsequent maximum allowable NTSD speed values, wherein said violation speed profile has a deceleration rate greater than that of said monitoring speed profile;

wherein said processor means generates speed request signals, in said terminal landing zone, having a constant deceleration slope, wherein said processor means generates speed request signals, during a jerk-in portion of velocity dictation, prior to the car reaching the constant deceleration zone, having a non-constant slope, and wherein said NTSD includes means for calculating NTSD values, during the jerk-in portion of velocity dictation, based upon a theoretical speed dictation pattern which has the same deceleration rate as the constant deceleration slope.

5. In an elevator system comprising a car, a plurality of landings including upper and lower terminal landings, a motor/drive means for moving said car between landings, processor means for generating speed request signals, and a drive control means for generating speed control signals and supplying said speed control signals to said motor/drive means; and wherein said drive control means includes a Normal Terminal Stopping Device ("NTSD") comprising means for periodically determining absolute car position when said car is within a predetermined terminal landing zone; means for generating maximum allowable NTSD speed values for various car positions in said terminal landing zone during deceleration; and means, responsive to receiving a speed request signal from said processor means, for determining an instantaneous maximum speed from said maximum allowable speed values and for supplying the lower of said instantaneous allowable maximum speed and said speed request signal as a speed control signal to said motor/drive means;

the improvement wherein said NTSD includes means for generating a monitoring speed profile for providing maximum allowable NTSD speed values during normal elevator operation; means, responsive to receiving a speed request signal in excess said maximum allowable NTSD speed, for generating a violation speed profile, for providing subsequent maximum allowable NTSD speed values, wherein said violation speed profile has a deceleration rate greater than that of said monitoring speed profile;

said elevator system further comprising a plurality of checkpoints in said terminal landing zones, sensing means for determining when said elevator car passes each checkpoint for generating a vane interrupt signal; means for generating actual speed signals representing elevator velocity; and means for storing an elevator contract speed; wherein the means for generating maximum allowable NTSD speed values for various car positions comprises means, responsive to a "learn" command, for setting an initial vane count MXV equal to or greater than the number of vanes needed for proper installation; means responsive to a "learn run" command, for moving said car into an upper or lower terminal landing at normal speeds, and for storing actual speed signals responsive to each vane interrupt signal; means for resetting MXV, following a learn run, to the actual number of checkpoints, thereby forming an NTSD table for each actual MXV checkpoint; and means for generating an error signal if at least one checkpoint speed value has not reached contract speed.

6. An elevator system according to claim 5, wherein the means for generating maximum allowable NTSD speed values includes means, following a learn run, where more than a predetermined number of checkpoints are at contract speed, for discarding checkpoints further away from said terminal landing than said predetermined number and for reducing MXV accordingly.

7. In an elevator system comprising a car, a plurality of landings including upper and lower terminal landings, a motor/drive means for moving said car between landings, processor means for generating speed request signals, and a drive control means for generating speed control signals and supplying said speed control signals to said motor/drive means; and wherein said drive control means includes a Normal Terminal Stopping Device ("NTSD") comprising means for periodically determining absolute car position when said car is within a predetermined terminal landing zone; means for generating maximum allowable NTSD speed values for various car positions in said terminal landing zone during deceleration; means, responsive to receiving a speed request signal from said processor means, for determining an instantaneous maximum speed from said maximum allowable speed values and for supplying the lower of said instantaneous allowable maximum speed and said speed request signal as a speed control signal to said motor/drive means; wherein said processor means generates speed request signals, in said terminal landing zone, having a constant deceleration slope; and wherein said processor means generates speed request signals, during a jerk-in portion of velocity dictation, prior to the car reaching the constant deceleration zone, having a non-constant slope;

the improvement wherein said NTSD includes means for calculating NTSD values, during the jerk-in portion of velocity dictation, based upon a theoretical speed dictation pattern which has the same deceleration rate as the constant deceleration slope.

8. An elevator system comprising a car, a plurality of landings including upper and lower terminal landings, a motor/drive means for moving said car between landings, processor means for generating speed request signals, and a drive control means for generating speed control signals and supplying said speed control signals to said motor/drive means; wherein said drive control means includes a Normal Terminal Stopping Device ("NTSD") comprising means for periodically determining absolute car position when said car is within a predetermined terminal landing zone, said means comprising a plurality of checkpoints in said terminal landing zones and sensing means for determining when said elevator car passes each checkpoint for generating a vane interrupt signal; means for generating maximum allowable NTSD speed values for various car positions in said terminal landing zone during deceleration; means, responsive to receiving a speed request signal from said processor means, for determining an instantaneous maximum speed from said maximum allowable speed values and for supplying the lower of said instantaneous allowable maximum speed and said speed request signal as a speed control signal to said motor/drive means; means for generating actual speed signals representing elevator velocity; and means for storing an elevator contract speed; wherein the means for generating maximum allowable NTSD speed values for various car positions comprises means, responsive to a "learn" command, for setting an initial vane count MXV equal to or greater than the number of vanes needed for proper installation; means responsive to "learn run" command, for moving said car into an upper or lower terminal at normal speeds, and for storing actual speed signals responsive to each vane interrupt signal; means for resetting MXV, following a learn run, to the actual number of checkpoints, thereby forming an NTSD table for each actual MXV checkpoint; and means for generating an error signal if at least one checkpoint speed value has not reached contract speed.

9. An elevator system according to claim 8, wherein the means for generating maximum allowable NTSD speed values includes means, following a learn run, where more than a predetermined number of checkpoints are at contract speed, for discarding checkpoints further away from said terminal landing than said predetermined number and for reducing MXV accordingly.

10. In an elevator system comprising a car, a plurality of landings including upper and lower terminal landings, a motor/drive means for moving said car between landings, processor means for generating speed request signals, means for generating speed signals representative of actual car velocity, and a drive control means for generating speed control signals and supplying said speed control signals to said motor/drive means; and wherein said drive control means includes a Normal Terminal Stopping Device ("NTSD") comprising a plurality of checkpoints, located within a predetermined landing zone of at least one of said upper and lower terminal landings, means for sensing when said car passes said checkpoints for determining absolute car position; means for generating first and second maximum allowable NTSD checkpoint speed values for a first checkpoint and a second checkpoint, respectively; speed profile generating means for generating maximum allowable NTSD speed values between said first and second checkpoints, wherein said first checkpoint speed is used as a starting speed, and the generated speed profile decelerates at a predetermined rate until reaching said second NTSD checkpoint speed, whereafter the generated speed is maintained at said second NTSD checkpoint speed until said car reaches said second checkpoint; and means, responsive to receiving a speed request signal from said processor means, for determining an instantaneous maximum speed from said maximum allowable speed values and for supplying the lower of said instantaneous allowable maximum speed and said speed request signal as a speed control signal to said motor/drive means;

the improvement wherein said NTSD includes means, responsive to sensing said first checkpoint, for determining at least one pseudo checkpoint, lying at a predetermined location between said first and second checkpoints, means for determining an interpolated NTSD speed value for said pseudo checkpoint, and means, responsive to said speed signals, for determining when said car has reached said pseudo checkpoint, and wherein said speed profile generating means uses said interpolated NTSD speed value in place of said second checkpoint speed until said car reaches said pseudo checkpoint, whereupon said speed profile generating means uses said interpolated NTSD speed value as the starting speed value and the generated speed profile decelerates at said predetermined rate until reaching said second NTSD checkpoint speed.

* * * * *